US008532556B2

(12) United States Patent
Yokokawa

(10) Patent No.: US 8,532,556 B2
(45) Date of Patent: Sep. 10, 2013

(54) TONER COLLECTING APPARATUS, CARTRIDGE, AND IMAGE FORMING APPARATUS

(75) Inventor: Kazuki Yokokawa, Moriya (JP)

(73) Assignee: Canon Finetech Inc., Misato-shi (JP)

( * ) Notice: Subject to any disclaimer, the term of this patent is extended or adjusted under 35 U.S.C. 154(b) by 232 days.

(21) Appl. No.: 12/975,927

(22) Filed: Dec. 22, 2010

(65) Prior Publication Data

US 2011/0158723 A1 Jun. 30, 2011

(30) Foreign Application Priority Data

Dec. 24, 2009 (JP) ..... 2009-293547
Dec. 17, 2010 (JP) ..... 2010-281412

(51) Int. Cl.
*G03G 21/00* (2006.01)
*G03G 15/08* (2006.01)

(52) U.S. Cl.
USPC ..... 399/358; 399/120

(58) Field of Classification Search
USPC ..... 399/358, 360, 120, 123
See application file for complete search history.

(56) References Cited

U.S. PATENT DOCUMENTS

2008/0013998 A1* 1/2008 Kumagai et al. ..... 399/358
2008/0124119 A1* 5/2008 Oda ..... 399/120
2010/0021204 A1* 1/2010 Nakazawa et al. ..... 399/120

FOREIGN PATENT DOCUMENTS

JP 62-163085 A 7/1987
JP 7-306578 A 11/1995
JP 07306578 A * 11/1995
JP 2003-162192 A 6/2003
JP 2007-218936 A 8/2007

OTHER PUBLICATIONS

Machine translation of reference Inada et al. (JP Pub No. 2007-218,936 A), Listed in IDS. Pub date Aug. 30, 2007.*
Notification of Reason for Refusal dated Aug. 28, 2012, in Japanese Application No. 2010-281412.

* cited by examiner

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

A toner collecting apparatus which transports collected toner through a discharge pipe to discharge the collected toner from a discharge port of the discharge pipe, the toner collecting apparatus including: a cover pipe having an open window and being rotatable around the discharge pipe in a substantially concentric fashion; a protective wall covering at least apart of the cover pipe; and a rotation member which rotates the cover pipe, wherein the cover pipe is rotated by the rotation member between an open position in which the open window is aligned with the discharge port and a closed position in which the open window is shifted from the discharge port so that at least the open window is covered with the protective wall.

10 Claims, 13 Drawing Sheets

TONER COLLECTING APPARATUS, CARTRIDGE, AND IMAGE FORMING APPARATUS

BACKGROUND OF THE INVENTION

1. Field of the Invention

The present invention relates to a toner collecting apparatus and a cartridge structured so as to transport and discharge toner collected in a container through a discharge pipe, and also relates to an image forming apparatus.

2. Description of the Related Art

A toner collecting apparatus is used, for example, in an image forming apparatus using an electrostatic latent image, such as a printer, a copying machine, and a facsimile. In the image forming apparatus, an electrostatic latent image is formed on a photosensitive member, the electrostatic latent image is visualized into a toner image by a toner developing device, and the toner image is transferred to and fixed on a recording sheet to obtain an intended recorded substance. A part of the toner supplied onto the photosensitive member from the developing device remains on the photosensitive member, and hence, the toner is removed by a cleaning mechanism to be collected in a toner collecting apparatus.

The toner collecting apparatus is attached to the cleaning mechanism for removing toner adhering to the photosensitive member, and includes a toner collecting container for containing toner transported through a discharge pipe. However, in a unit of a toner collecting apparatus integrated with cleaning mechanism, a photosensitive member, etc., for example, the toner collecting apparatus is to be attached to and detached from a main body together with the entire unit during maintenance or replacement of components. When the toner collecting apparatus is thus pulled out from the main body, there is a fear that toner may scatter from a discharge port of the discharge pipe. Therefore, various countermeasures against the scattering of toner have conventionally been proposed.

As the conventionally proposed countermeasures, there is known an apparatus in which a tubular shutter neither is provided at a discharge port of a discharge pipe, and the discharge port of the discharge pipe is closed with the shutter member by a biasing force of elastic biasing members while a toner collecting apparatus is removed from a main body (Japanese Patent Application Laid-Open Nos. S62-163085 and 2003-162192).

However, when the shutter member comes into contact with an object due to a human factor while the toner collecting apparatus is removed from the main body, the shutter member is moved against the biasing force of the elastic biasing members to allow toner to scatter, which may degrade image quality inside the apparatus and may contaminate the room outside the apparatus. Further, an apparatus provided with a lock member for regulating a shutter member at a closed position has also been proposed (Japanese Patent Application Laid-Open No. 2003-162192). However, there still remains a problem that toner adhering to the vicinity of an opening of the shutter member contaminates the hand of a user during operation. Further, in an apparatus in which a full-tank condition of a toner collecting container is detected to give warning by causing a placing tray of the toner collecting container to move up/down according to the weight in order to obtain an amount of toner contained in the toner collecting container, there is a fear that the movement of the toner collecting container may cause trouble with respect to the movement of the shutter member.

On the other hand, in an image forming apparatus such as a color printer and a copying machine, there are widely employed such structures that color-based drum cartridges filled with toner of yellow (Y), magenta (M), cyan (C), and black (K) are used in terms of the convenience of toner replenishment, and that a photosensitive drum and components in the periphery of the photosensitive drum are placed together in a detachable central processing unit so as to enhance the convenience of maintenance and repair. However, in an image forming apparatus in which color-based drum cartridges are attached for use, if a cartridge is attached to a wrong position, a problem of color mixture occurs, and hence, it is necessary to design so that each cartridge can be attached only to a predetermined position based on a color and cannot be attached to the other positions. Therefore, a technology of attaching an IC tag to a drum cartridge so as to obtain information is known as a conventional technology. In this technology, there is a fear that an unnecessary operation may be caused in replacement because a drum cartridge is not determined unless it is inserted and a power is turned on.

SUMMARY OF THE INVENTION

View of the above-mentioned problems, an object of the present invention is to provide a toner collecting apparatus with satisfactory convenience of a toner collecting container replacement operation performed by a user or the like. More specifically, an object of the present invention is to provide a toner collecting apparatus in which toner adhering to the vicinity of an opening of a shutter member through which toner is discharged is prevented from contaminating the hand of a user and from scattering.

Another object of the present invention is to provide an image forming apparatus in which the suitability in use of a drum cartridge including a toner collecting apparatus can be determined with a simple structure.

In order to achieve the above-mentioned object, according to the present invention, there is aims to provide a tenet collecting apparatus which transports collected toner through a discharge pipe to drop and discharge the collected toner from a discharge port provided in the discharge pipe, the toner collecting apparatus including: a cover pipe having an open window and being rotatable on an outer circumferential side of the discharge pipe in a substantially concentric fashion; a protective wall covering at least a part of the cover pipe on an outer circumferential side of the cover pipe; and a rotation member which rotates the cover pipe, wherein in a case in which the cover pipe is rotated by the rotation member from an open position at which the open window is aligned with the discharge port of the discharge pipe to a closed position at which the open window is shifted from the discharge port of the discharge pipe, at least the open window of the cover pipe is rotated to a position at which the open window is covered with the protective wall.

According to the present invention with such a structure, even when toner adheres to the open window of the cover pipe that opens/closes the discharge port of the discharge pipe, the open window of the cover pipe is covered with the protective wall when the discharge port of the discharge pipe is closed. Therefore, an operator does not come into contact with the open window of the cover pipe, which prevents toner from scattering.

Further, in the present invention, in a cartridge structured so that the toner collecting apparatus is a part of a unit to be detachably mountable to the main body, it is desired that a lock mechanism disabling the rotation of the cover pipe be provided when the unit is detached from the main body.

According to the present invention having such a structure, the cover pipe is locked in a case where the cartridge is not used, and hence, toner is further prevented from scattering.

Further, it is desired that the above-mentioned unit of the present invention be structured so that an intermediate gear transmitting the rotation force to the cover pipe and a gear of the main body are provided, and suitability in use of the main body and the unit to be attached to the main body be determined based on a mesh state of the intermediate gear.

According to the present invention having such a structure, the attachment of an unsuitable unit can be determined based on the mesh state of the intermediate gear, and hence, the attachment of a suitable unit is ensured easily.

As described above, according to the present invention, the protective wall is provided, which covers at least the open window of the cover pipe when the discharge port of the discharge pipe is closed by causing the open window of the cover pipe to rotate, the open window of the cover pipe is rotated in the protective wall when the discharge port of the discharge pipe is closed to prevent an operator from coming into contact with the open window of the cover pipe, the toner adhering to the open window of the cover pipe that opens/closes the discharge port of the discharge pipe is prevented from scattering, and thus, the scattering of toner from the discharge port of the discharge pipe and the inconvenience of an operation can be prevented satisfactorily. Accordingly, the reliability of a toner collecting apparatus, an image forming apparatus including the toner collecting apparatus and the like can be enhanced remarkably at low cost.

Further features of the present invention will become apparent from the following description of exemplary embodiments with reference to the attached drawings.

BRIEF DESCRIPTION OF THE DRAWINGS

FIG. 10A is a vertical cross-sectional explanatory view illustrating an attached state of a drum cartridge. FIG. 10B is a vertical cross-sectional explanatory view illustrating a removal state of the drum cartridge from the main body.

DESCRIPTION OF THE EMBODIMENTS

Hereinafter, the embodiments of the present invention will be described in detail with reference to the drawings.

Figure 1:
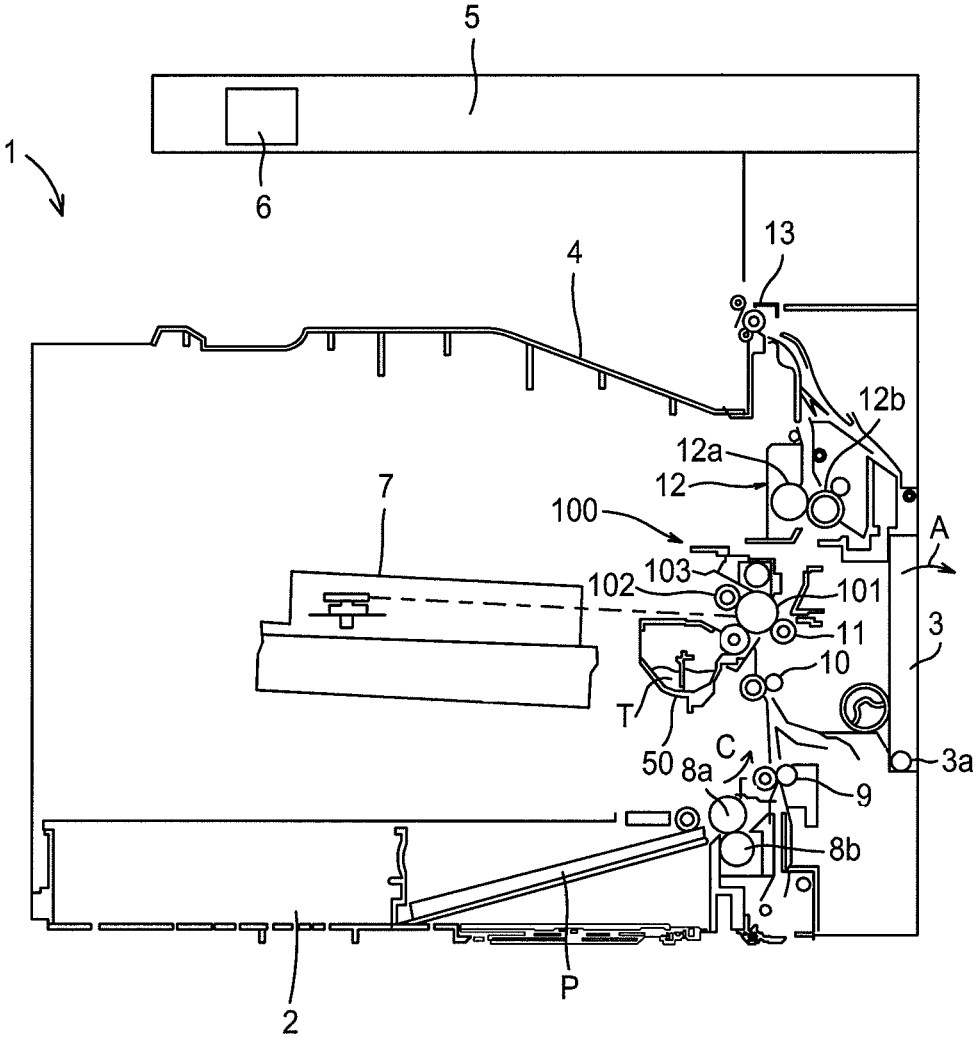
FIG. 1 is a vertical cross-sectional explanatory view illustrating schematically an internal structure of a copying machine in Embodiment 1 of the present invention.

As illustrated in FIG. 1, in a main body (hereinafter, referred to as "copying machine main body") of a copying machine 1 that is an example of an image forming apparatus of the present invention, a universal cassette 2 containing a plurality of cut sheets (recording media) P is provided so as to be freely loaded on or unloaded from the main body. Further, in a right-side wall portion of the copying machine main body illustrated in FIG. 1, a rectangular manual feed tray 3 capable of feeding a recording medium P of a small size such as a postcard is provided so as to be openable and closable. The manual feed tray 3 is structured so as to rotate in a direction indicated by an arrow A around a lower portion and to be opened to a position (not shown) where the recording medium P can be placed. Further, in an upper part of the copying machine main body, a discharge tray 4, on which the recording mediums P with images formed thereon are stacked, is formed. An operation panel (not shown) to which the number of copying is input is disposed on a front side of a top surface of the discharge tray 4, and a reading scanner 5 reading an image of an original to be copied is disposed above the discharge tray 4.

Next, a procedure of forming an image in the copying machine 1 will be described together with the structure of an image forming portion.

An image on an original is read by a reading lens 6 provided in the reading scanner 5, and image information is converted into an image signal by a central processing unit (not shown). The image signal is converted into an electric signal by the central processing unit (not shown) provided in the copying machine main body and sent to a well-known laser irradiation device 7. Laser light (represented by a broken line) is applied to a photosensitive drum 101 disposed in a drum cartridge at a timing of laser irradiation according to the electric signal. The photosensitive drum 101 is charged uniformly by a charging roller 102, and the photosensitive drum 101 is irradiated with the laser light, to thereby form an electrostatic latent image on the photosensitive drum 101. The electrostatic latent image is developed with developer (toner) T supplied from a developing device 50 to form a toner image.

Then, the recording mediums P placed on the above-mentioned universal cassette 2 is separated sheet by sheet by a feed roller 8*a* and a separation roller 8*b* to be fed in a direction indicated by an arrow C (feed direction), and conveyed upward in FIG. 1 by a conveyance roller pair 9. Further, the leading end of the recording medium P is stopped for a predetermined period of time with an image leading end position being adjusted by a registration roller pair 10 provided on a downstream side in the conveying direction. After that, the recording medium P is sent to a transfer roller 11 and the above-mentioned toner image is transferred to the recording medium P. The recording medium P with the toner image being transferred thereon is conveyed to a fixing unit 12. The fixing unit 12 includes a heat roller 12*a* and a pressure roller 12*b*, and the recording medium P is conveyed while being sandwiched between these two rollers and the toner image is fixed on the recording medium P. The recording medium P with the toner image being fixed thereon is discharged by a pair of discharge rollers 13 to be stacked on a discharge tray 4.

On the other hand, toner (developer) remaining on the photosensitive drum 101 after being transferred is scraped off by a cleaning blade 103 provided in a cleaning device 100. The toner thus scraped off is collected in a collecting box (toner receiving portion) 200 described later. Further, as described above, the recording medium P can also be fed from the manual feed tray 3, and a procedure in which an image is formed on the recording medium P fed from the manual feed tray 3 is the same as the above.

Thus, various components and members are incorporated in an image forming portion of the copying machine 1. Among these components, the charging roller 102, the photosensitive drum 101, and the cleaning device 100 constitute a drum cartridge 110 (FIG. 3) as a unit to be remounted/detached integrally with respect to the image forming portion of the copying machine main body. The drum cartridge 110 is structured so as to be mounted in an inner direction and detached in an outer direction with respect to the copying machine main body together with the developing device 50.

Figure 2:
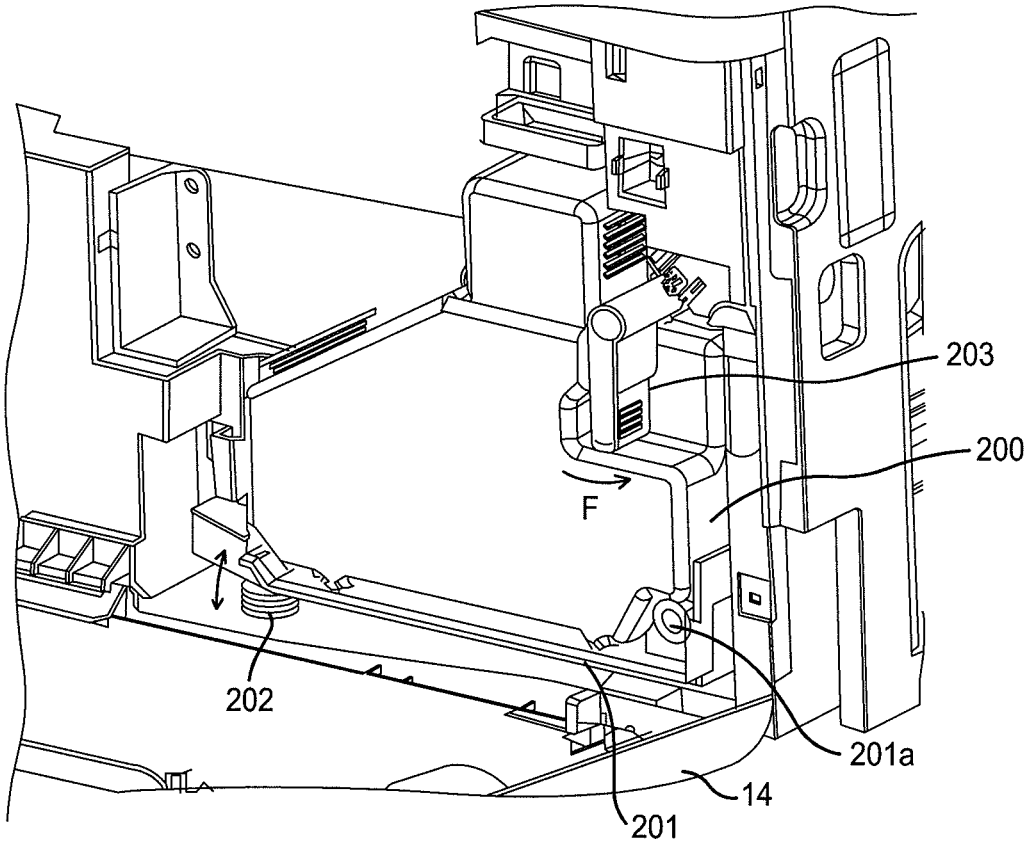
FIG. 2 is a perspective explanatory view illustrating an enlarged part of the copying machine illustrated in FIG. 1 in a state in which a front cover is opened.

Further, as illustrated in FIG. 2, the collecting box 200 containing toner discharged from the above-mentioned drum cartridge is mounted so as to be detachably mountable from a front surface side (operation front side) of the copying machine main body. Then, the copying machine front cover 14 disposed so as to cover the front surface side of the copying machine main body is attached so as to be openable and closable about a horizontal rotation axis disposed below the copying machine main body. Further, a box tray 201 is disposed closely in an inside portion of the copying machine front cover 14, and the collecting box 200 is detachably mounted to the box tray 201, and thus, the collecting box 200 can be mounted from the front side of the copying machine main body.

Then, the drum cartridge 110 (FIG. 3) is disposed so as to overlap a part of the collecting box 200 in a front and back direction. The above-mentioned box tray 201 is provided with a rotation fulcrum 201*a* in a right corner portion, when viewed from the operation front side. The box tray 201 rotates through a predetermined angle range in a direction indicated by an arrow D in FIG. 2 around the rotation fulcrum 201*a*, and thus, the entire box tray 201 moves up and down. At this time, on a lower surface in a left corner portion, when viewed from the operation front side of the box tray 201, a compression spring 202 biasing the box tray 201 upward is provided.

The elastic force of the compression spring 202 is set in such a manner as to lower the collecting box 200 with respect to the weight when collected toner (developer) is contained to the full in the collecting box 200. Then, a known photointerrupter is provided on a back side rear surface of the box tray 201 in the vicinity of the compression spring 202, and detection is performed at a position where the box tray 201 is lowered by a predetermined amount. This enables the full-tank condition of the collecting box 200 to be detected when the collecting box 200 is completely filled with toner.

Further, in a diagonally upper right portion of the collecting box 200, when viewed from the front surface on the operation front side, an operation lever 203 is provided so as to overlap a part of the collecting box 200 in a front and back direction. The operation lever 203 is disposed so as to cover the front surface side of the collecting box 200, i.e., the front surface on the operation front side in an ordinary use state so that the collecting box 200 cannot be removed. On the other hand, when the operation lever 203 is rotated in a direction indicated by an arrow F, the operation lever 203 comes off from the collecting box 200, and the collecting box 200 can be removed from the copying machine main body in the absence of the regulation of the operation lever 203. Then, in a state in which the operation lever 203 is rotated, a protruding portion (not shown) provided at the copying machine front cover 14 and the operation lever 203 interfere with each other, which makes it impossible to close the copying machine front cover 14. Further, in a state in which the copying machine front cover 14 is opened, a sensor (not shown) performs control so that all the operations regarding the formation of an image are not performed.

Figure 3:
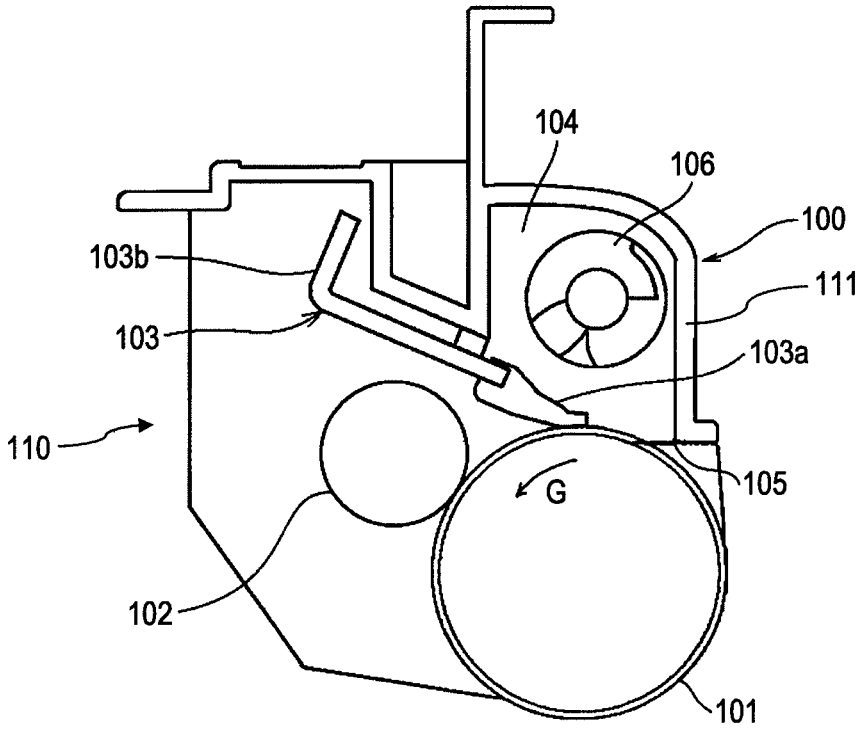
FIG. 3 is a lateral cross-sectional explanatory view of a drum cartridge used in the copying machine illustrated in FIGS. 1 and 2.

Next, the drum cartridge 110 will be described in detail. As illustrated in FIG. 3, on an outer circumferential surface of the photosensitive drum 101 provided in the drum cartridge 110, a cleaning blade 103 in which urethane rubber 103*a* is integrated with a steel plate 103*b* is disposed in contact, and on a downstream side of a rotation direction (direction indicated by an arrow G in FIG. 3) of the photosensitive drum 101, the charging roller 102 having a predetermined resistance is disposed in contact with a contact pressure of about 0.4 N. As described above, the toner (developer) remaining on the photosensitive drum 101 is scraped off by the cleaning blade 103 and stored in a cleaning chamber 104 in an upper portion. Further, a PET sheet 105 having a thickness of 38 μm is attached to a wall surface on an upstream side of the cleaning chamber 104 in the rotation direction. In this manner, the toner to be stored in the cleaning chamber 104 does not spill out.

Further, in the above-mentioned cleaning chamber 104, a transport screw 106 forming a spiral shape as a toner collecting apparatus is disposed so as to extend substantially horizontally from a back side of the apparatus to a front side, and the transport screw 106 receives rotation force from the main body drive (not shown) to discharge toner stored in the cleaning chamber 104 out of the drum cartridge 110. Due to the toner collecting apparatus including the transport screw 106, the cleaning chamber 104 is not completely filled with toner, and the drum cartridge 110 can be used up to the end of the life of the photosensitive drum 101.

Figure 4:
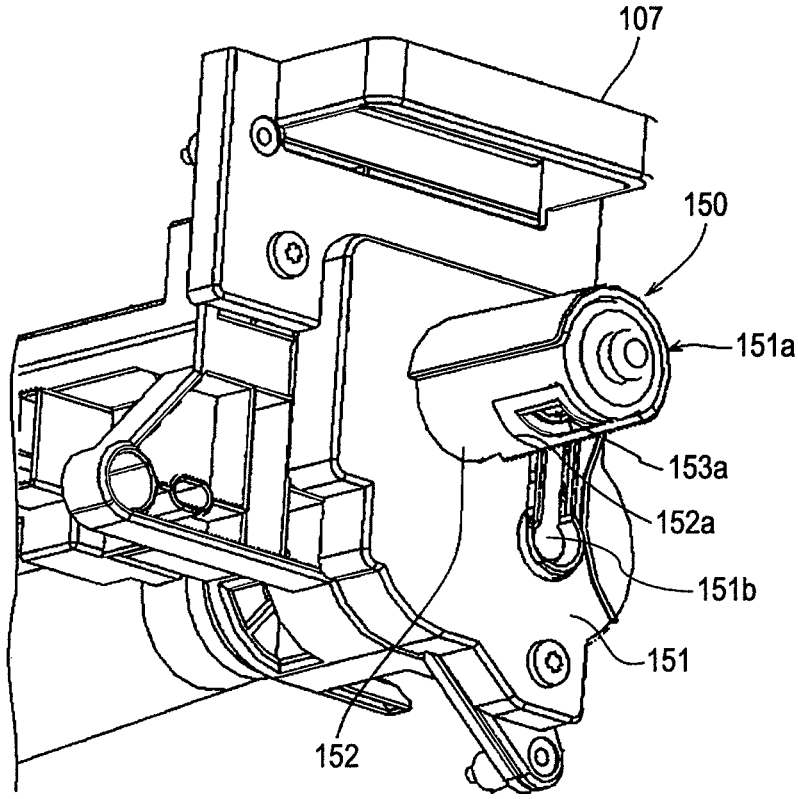
FIG. 4 is a partial perspective view of a toner collecting apparatus according to Embodiment 1 of the present invention provided in the drum cartridge illustrated in FIG. 3, when viewed from a lower side.

Still further, particularly, as illustrated in FIG. 4, a handle 107 for pulling and moving the drum cartridge 110 is provided at an upper position of the operation front wall surface of the above-mentioned drum cartridge 110, and a toner discharge portion (toner discharging apparatus) 150 in a substantially cylindrical shape as the toner collecting apparatus is provided at a position below the handle 107 so as to protrude toward the front side. The toner discharge portion 150 includes a discharge port 153*a* for discharging toner in a lower part, and a protective wall 151*a* integrated with a cover 151 of the drum cartridge 110 is fixed on an upper outer circumferential portion of the toner discharge portion 150. The protective wall 151*a* is formed so as to form an arc shape opened downwardly when viewed from the operation front side, and in a portion on a lower half side of the toner discharge portion 150 without the protective wall 151*a*, a lower side portion of a cover pipe (lid member) 152 described later is provided so as to be exposed.

Figure 5:
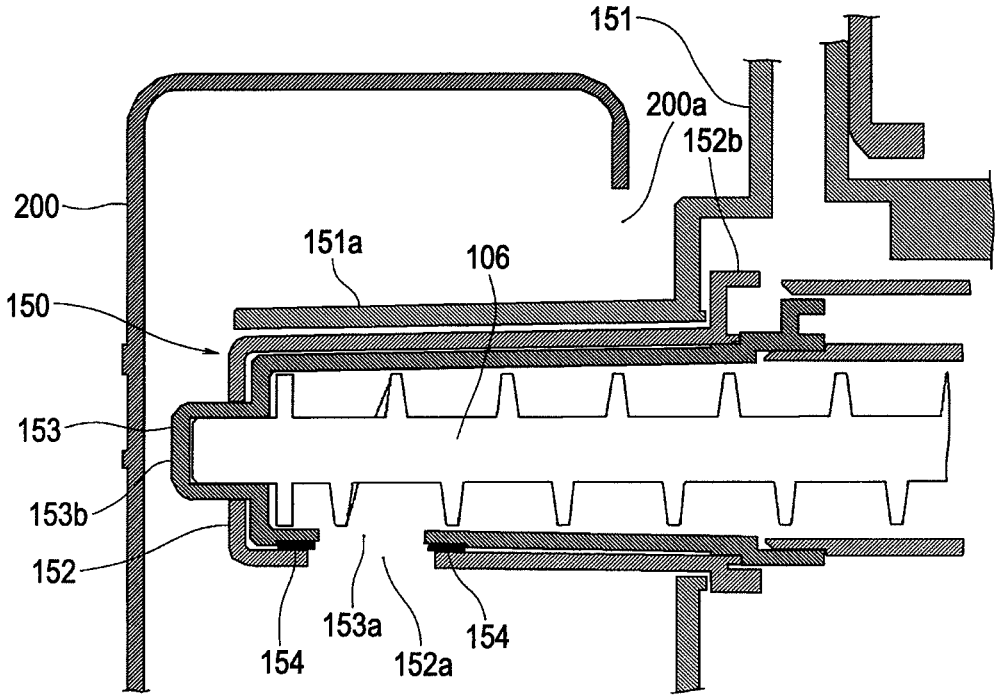
FIG. 5 is a vertical cross-sectional explanatory view illustrating schematically an internal structure of the toner collecting apparatus according to Embodiment 1 of the present invention illustrated in FIG. 4 in a state in which a collecting box is attached.

Here, particularly, as illustrated in FIG. 5, on a wall surface on the back side (right side in FIG. 5) of the collecting box 200 to be attached to the toner discharge portion 150, an opening hole 200*a* through which the toner discharge portion 150 is inserted is provided. When a tip end of the toner discharge portion 150 is inserted in the collecting box 200 through the opening hole 200*a*, the toner discharge portion 150 is set so that the collecting box 200 covers the tip end of the toner discharge portion 150 from the outer side.

As described above, the cover pipe 152 having a substantially cylindrical shape is disposed so as to be rotatable in a substantially concentric fashion on a curved inner side (lower side) of the protective wall 151*a* provided at the drum cartridge 110, and similarly, the discharge pipe (discharge unit) 153 is fixed in the substantially concentric fashion on an inner side of the cover pipe 152. Then, the transport screw 106 that discharges toner from the above-mentioned cleaning chamber 104 is disposed so as to rotate in the discharge pipe 153. The tip end (left end portion of FIG. 5) of the transport screw 106 is rotatably supported by a bearing portion 153*b* provided in the tip end (left side portion of FIG. 5) of the discharge pipe 153, and there is a gap of about 0.1 mm between the outer circumferential portion of the transport screw 106 and the inner circumferential wall surface of the discharge pipe 153.

Further, in a portion closer to the tip end (closer to the left end of FIG. 5) of the discharge pipe 153, a discharge port 153*a* that drops down toner to discharge the toner is formed so as to form an opening in a substantially rectangular shape facing downwardly. On an outer surface side of an opening edge around the discharge port 153*a* provided at the discharge pipe 153, a seal 154 made of a sponge material is adhered along a site at which the outer surface of the opening edge is recessed by about 0.8 mm.

Further, the tip end (left end portion of FIG. 5) of the cover pipe 152 is rotatably supported on an outer circumferential side of the bearing portion 153*b* provided at the discharge pipe 153, and the cover pipe 152 is rotated over a predetermined rotation angle. The cover pipe 152 is disposed so as to be rotatable between the protective wall 151*a* and the discharge pipe 153 and slidable in an axis direction. At this time, the discharge pipe 153 and the protective wall 151*a* are fixed at a cleaning container 111, and thus the cover pipe 152 is held without coming off in an axis direction.

Further, in a circumferential wall portion of the cover pipe 152, an open window 152*a* is provided at a circumferential direction phase position corresponding to the discharge port 153*a* of the discharge pipe 153 so as to form a substantially rectangular opening. The gap between the opening edge of the open window (open area) 152*a* provided in the cover pipe 152 and the opening edge of the discharge port 153*a* provided in the discharge pipe 153 is filled with the seal 154.

On the other hand, in a proximal portion (right portion of FIG. 5) of the above-mentioned cover pipe 152, a gear portion 152*b* that receives a rotation drive force is provided. When the entire cover pipe 152 is rotated by a rotation drive force from the intermediate gear 160 (FIG. 6), and because the open window 152*a* is rotated at this time, the discharge port 153*a* of the discharge pipe 153 is opened and closed. A relationship between the main body operation lever 203 that participates in the opening and closing function of the cover pipe 152 and the intermediate gear 160 attached to the drum cartridge 110 will be described with reference to FIG. 6.

Figure 6:
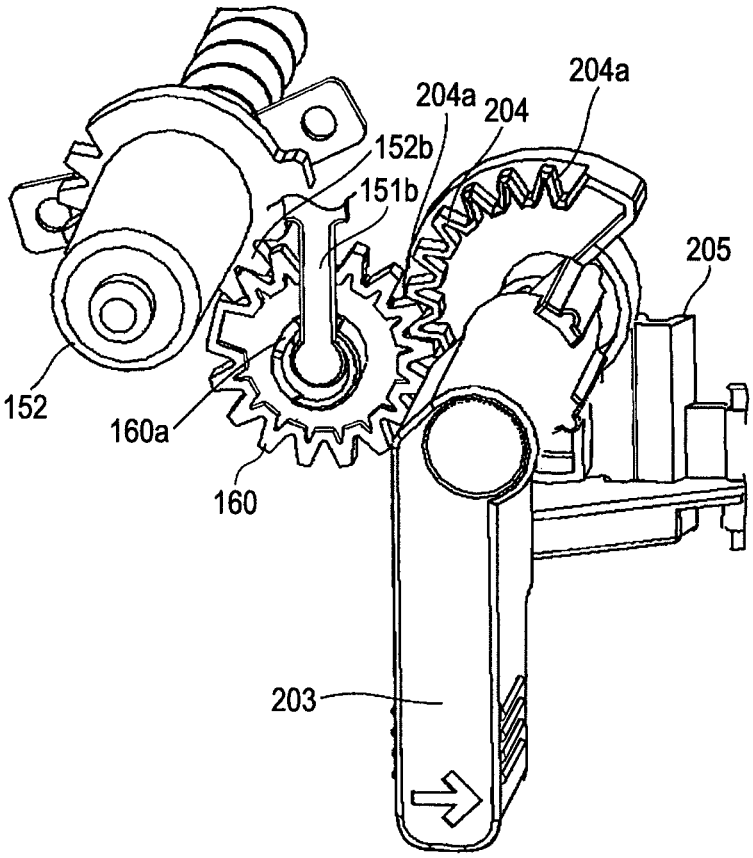
FIG. 6 is a perspective explanatory view of an external appearance illustrating schematically a relationship between a cover pipe and an operation lever used in the toner collecting apparatus illustrated in FIGS. 4 and 5.

FIG. 6 illustrates a relationship between the operation lever 203 and the intermediate gear 160 attached to the drum cartridge 110. On the proximal portion of a rotation axis of the operation lever 203, an operation lever gear 204 is provided. The operation lever gear 204 is rotatably supported by a main body frame (not shown). When the drum cartridge 110 is attached to a normal position, the operation lever gear 204 is meshed with the intermediate gear 160 provided at the drum cartridge 110. Further, a box presence/absence lock member 205 is provided in the vicinity of the operation lever gear 204. When the collecting box 200 is not attached, the box presence/absence lock member 205 comes into contact with the operation lever gear 204 so that the operation lever 203 cannot rotate.

The drum cartridge 110 is provided with the intermediate gear 160 as described above. In the drum cartridge 110A, the rotation drive force given from the operation lever gear 204 is transmitted to the gear portion 152*b* of the cover pipe 152 via the intermediate gear 160. The rotation axis of the intermediate gear 160 is supported by the cleaning container 111 constituting the cleaning chamber 104.

Further, the cover 151 (FIG. 4) of the drum cartridge 110 is integrally provided with a plate spring-shaped regulating portion 151*b* in a cantilever manner. A lower end portion of the plate spring-shaped regulating portion 151*b* is pressed against a boss portion of the intermediate gear 160 in an axis direction. More specifically, the intermediate gear 160 is urged by the elastic force of the plate spring-shaped regulating portion 151*b* toward the back side in the axis direction. Thereby, the intermediate gear 160 is regulated in the thrust direction.

Further, in a front side portion in the axis direction of the boss portion of the intermediate gear 160, a taper surface 160*a* is provided so as to from a substantially arc shape. When the intermediate gear 160 rotates in a right direction when viewed from the front side in FIG. 6, the intermediate gear 160 is pushed along the taper surface 160*a* into the back side in the axis direction, i.e., toward the cleaning container 111 by the pushing and biasing force of the plate spring-shaped regulating portion 151*b*. On the other hand, a flange portion 204*a* receiving a biasing force of the intermediate gear 160 is provided at the operation lever gear 204. The flange portion 204*a* regulates the intermediate gear 160 so that the intermediate gear 160 does not move to the cleaning container 111.

Figure 7A:
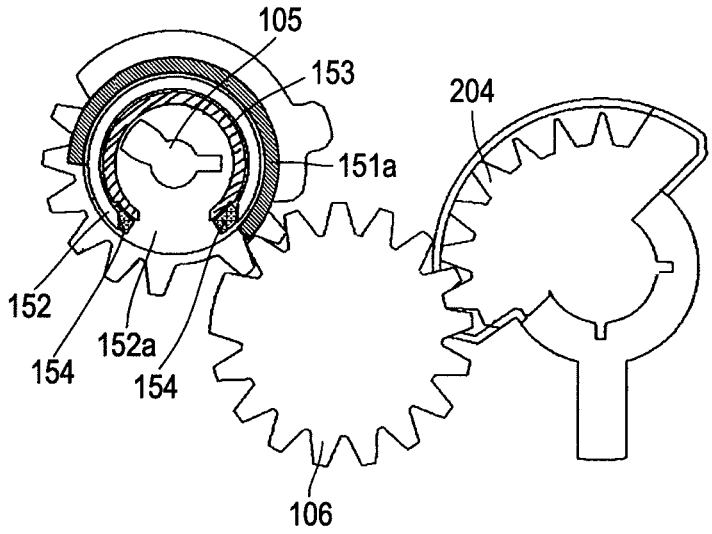
FIG. 7A is a front explanatory view illustrating schematically a positional relationship between the operation lever and a gear portion in a state in which the collecting box is attached.
Figure 7B:
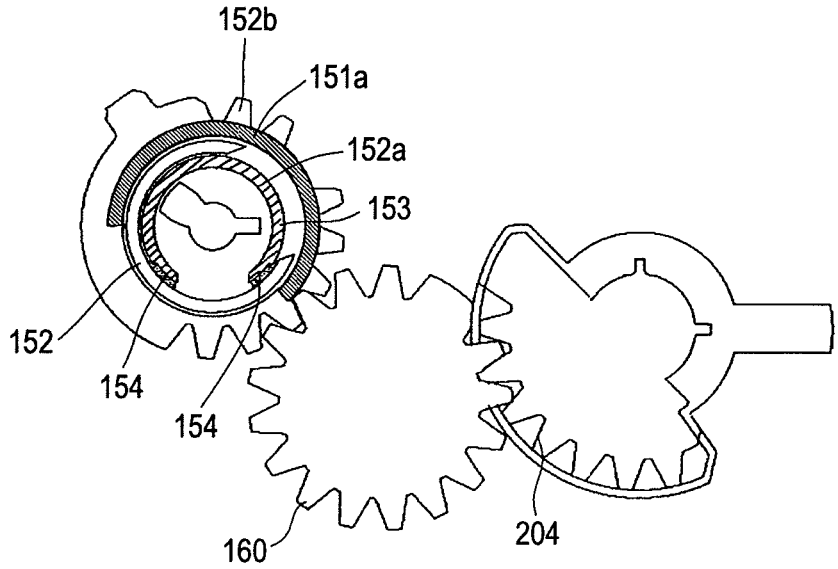
FIG. 7B is a front explanatory view illustrating schematically a positional relationship between the operation level and the gear portion in a state in which the collecting box is removed.
Figure 8:
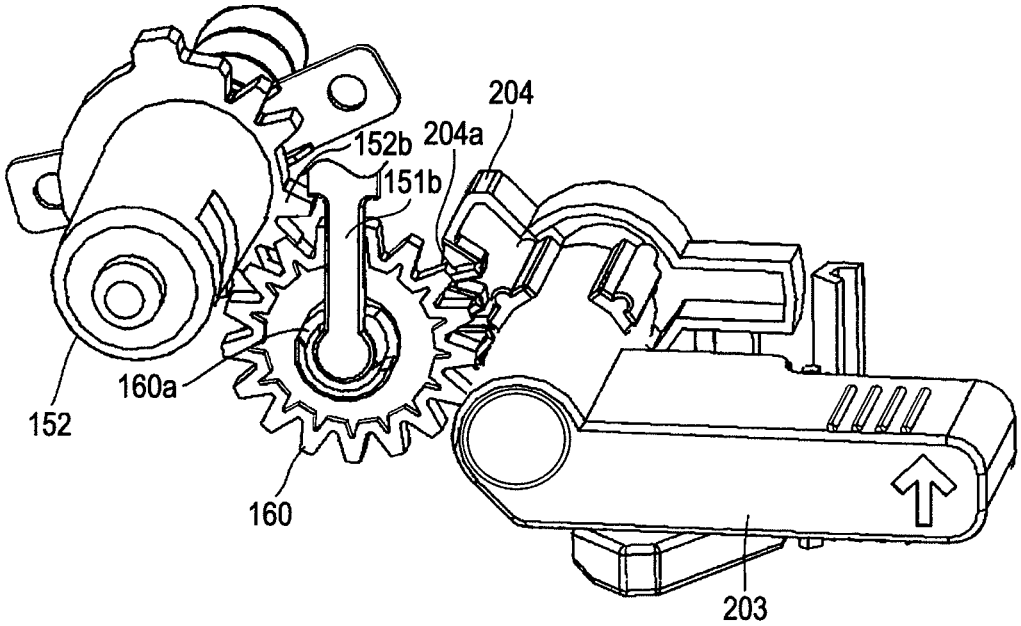
FIG. 8 is a perspective explanatory view of an external appearance illustrating a state in which the operation lever illustrated in FIG. 6 is rotated to remove the collecting box.

The operation lever 203 and each gear portion of the toner discharge portion 150 in each of the state in which the collecting box 200 is mounted and the state in which the collecting box 200 is detached has positional relationships as illustrated in FIGS. 7A and 7B. FIG. 8 illustrate a state in which the operation lever 203 is rotated to the state in which the collecting box 200 is detached.

More specifically, first, in the state in which the collecting box 200 is mounted as illustrated in FIG. 7A, the operation lever 203 is directed downward as illustrated in FIG. 6, and the open window 152*a* of the cover pipe 152 is rotated to be directed downward by the rotation force from the operation lever gear 204 of the operation lever 203 via the intermediate gear 160. Thus, the discharge port 153*a* of the discharge pipe 153 disposed on an inner side of the cover pipe 152 is exposed downward via the open window 152*a*, and the toner sent by the transport screw 106 is discharged into the mounted collecting box 200.

When the drum cartridge 110 is mounted, the intermediate gear 160 of the drum cartridge 110 is fitted onto the operation lever gear 204 so as to mesh with each other. The taper portion that receives smoothly a gear of a partner side is formed in a portion to be fitted along each gear edge line of the operation lever gear 204 and the intermediate gear 160. Therefore, when the drum cartridge 110 is mounted, the drum cartridge 110 does not damage the gear tooth surface of the intermediate gear 160 or the operation lever gear 204.

Next, when the operation lever 203 is rotated by about 90° in a counterclockwise direction when viewed from the front side, to a stopper position as illustrated in FIG. 8, the rotation force of the operation lever 203 is transmitted to the cover pipe 152, and the cover pipe 152 is finally rotated by about 110° in the counterclockwise direction when viewed from the front side. At this time, the open window 152*a* of the cover pipe 152 is directed slightly upward with respect to the horizontal direction, and further, is opposed to an inner circumferential wall surface of the protective wall 151*a* (FIG. 7B). That is, the cover pipe 152 is structured so that a portion including at least the entire open window 152*a* is housed in a curved inside portion of the protective wall 151*a* (FIG. 7B).

Further, simultaneously with the above, the plate spring-shaped regulating portion 151*b* elastically contacts the taper portion 160*a* provided in the boss portion of the intermediate gear 160. Therefore, the intermediate gear 160 is urged toward the cleaning container 111 on the back side. Consequently, even if the toner contained in the collecting box 200 increases in amount to the full to press down the collecting box 200, the edge portion of the opening hole 200*a* (FIG. 5) of the collecting box 200 comes into contact with the protective wall 151*a*. Thus, the rotation and sliding of the cover pipe 152 are not hindered.

Figure 9A:
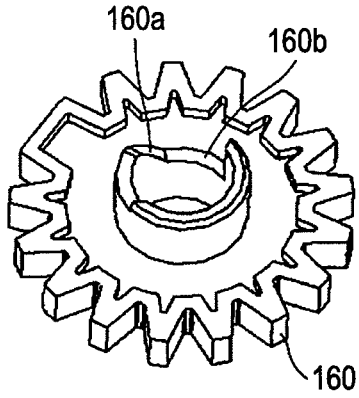
FIG. 9A is a perspective explanatory view of an external appearance of an outer side surface of an intermediate gear used in the toner collecting apparatus illustrated in FIGS. 4 to 8.

Here, on an outside end surface in the axis direction of the boss portion of the intermediate gear 160, the taper surface 160*a* and a concave surface 160*b* as illustrated in FIG. 9A are provided. In the case where the operation lever 203 is rotated to the position where the collecting box 200 is mounted and fixed, the plate spring-shaped regulating portion 151*b* provided at the cover 151 of the drum cartridge 110 enters the concave surface 160*b*. On the other hand, when the operation lever 203 is rotated to a position where the collecting box 200 can be detached, the plate spring-shaped regulating portion 151*b* comes into contact with the taper surface 160*a*. Thus, the intermediate gear 160 is urged toward the cleaning container 111 by the elastic force of the plate spring-shaped regulating portion 151*b*.

Figure 9B:
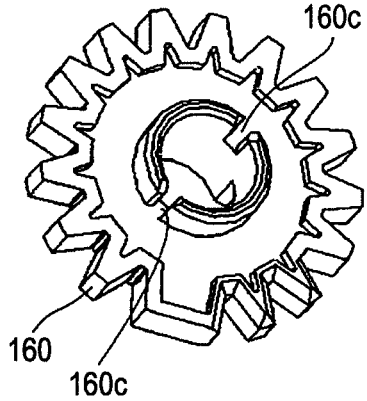
FIG. 9B is a perspective explanatory view of an external appearance of an inner side surface of the intermediate gear used in the toner collecting apparatus illustrated in FIGS. 4 to 8.
Figure 9C:
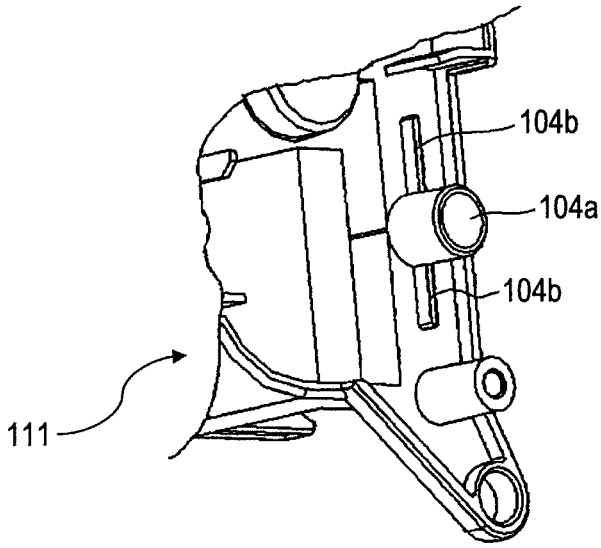
FIG. 9C is a perspective explanatory view of an external appearance of a wall surface structure on a container side used in the toner collecting apparatus illustrated in FIGS. 4 to 8.

Further, in the drum cartridge 110 as a unit, a lock mechanism disabling the rotation of the cover pipe 152 when the drum cartridge 110 is detached from the copying machine main body is provided. More specifically, as illustrated in FIG. 9B, in a portion of the intermediate gear 160 on the side of the cleaning container 111, a slit 160*c* is provided. On the other hand, in a side wall portion of the cleaning container 111 of the drum cartridge 110, embossed rib 104*a* to which the intermediate gear 160 is attached is provided. A rib 104*b* having a height equal to the depth of the slit 160*c* of the intermediate gear 160 is provided at the proximal portion of the embossed rib 104*a*. Then, when the operation lever 203 is rotated to the position where the collecting box 200 can be detached as described above, the slit 160*c* of the intermediate gear 160 illustrated in FIG. 9B is fitted onto the rib 104*b*, and the intermediate gear 160 is held in a locked state so that the intermediate gear 160 cannot be rotated.

Figure 10A:
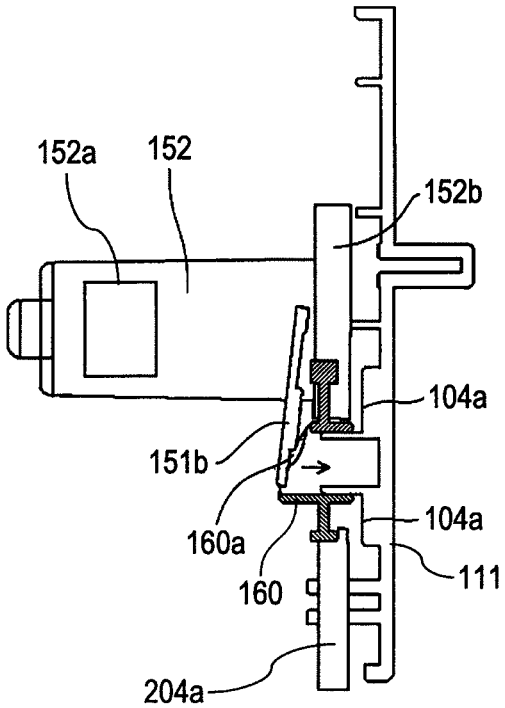
FIGS. 10A and 10B illustrate a movement state of the intermediate gear used in the toner collecting apparatus illustrated in FIGS. 4 to 8.

As described above, the toner collecting apparatus in this embodiment is structured so as to form a part of the drum cartridge 110 to be detachably mountable to the main body, and a lock mechanism that disables the rotation of the cover pipe 152 when the drum cartridge 110 is detached from the main body is provided. More specifically, as illustrated in FIG. 10A, when the drum cartridge 110 is detached, the operation lever 203 is rotated to the position where the collecting box 200 can be detached as described above. In this state, as described above, the taper surface 160*a* of the intermediate gear 160 is urged by the plate spring-shaped regulating portion 151*b*, and the phase (position) of the slit 160*c* of the intermediate gear 160 is matched with that of the rib 104*b* of the cleaning container 111. However, the movement of the intermediate gear 160 is regulated by the flange portion 204*a* of the operation lever gear 204.

Figure 10B:
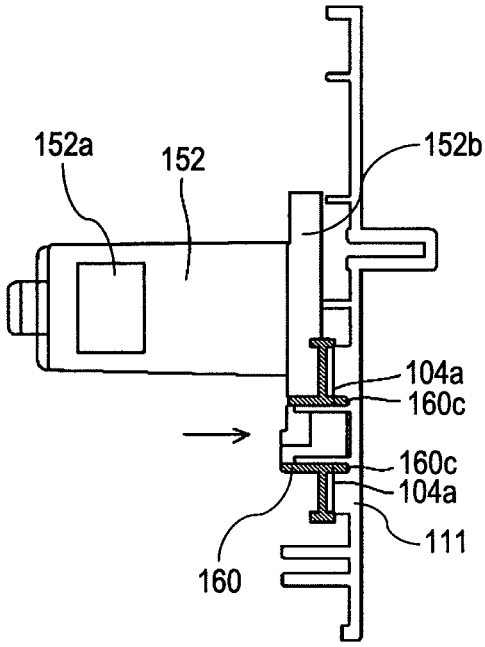

Then, when the drum cartridge 110 is pulled out from this state, as illustrated in FIG. 10B, the regulation by the flange portion 204*a* of the operation lever gear 204 is released, and the intermediate gear 160 moves in a direction indicated by an arrow of FIG. 10B by the biasing force of the plate spring-shaped regulating portion 151*b* with respect to the taper surface 106*a* of the intermediate gear 160. This causes the slit 160*c* of the intermediate gear 160 to be engaged with the rib 104*a* of the cleaning container 111, and thus, the rotation of the intermediate gear 160 is locked. Consequently, even when a user touches the cover pipe 152, the cover pipe 152 does not rotate, and the discharge port 153*a* is not opened by accident.

Thus, according to this embodiment, even when toner adheres to the open window 152*a* of the cover pipe 152 that opens and closes the discharge port 153*a* of the discharge pipe 153, the open window 152*a* of the cover pipe 152 is housed in the protective wall 151*a* when the discharge port 153*a* of the discharge pipe 153 is closed. Therefore, an operator does not come into contact with the open window 152*a* of the cover pipe 152, and toner is prevented from scattering. Further, the opening and closing operation of the cover pipe 152 is protected by the protective wall 151*a*, and thus, the opening and closing operation is continued without trouble.

Further, in this embodiment, a lock mechanism is provided, which disables the rotation of the cover pipe 152 when the drum cartridge 110 is detached from the main body. Therefore, in the case where the drum cartridge 110 is not used, the cover pipe 152 is locked, which further prevents toner scattering and contamination.

Figure 11:
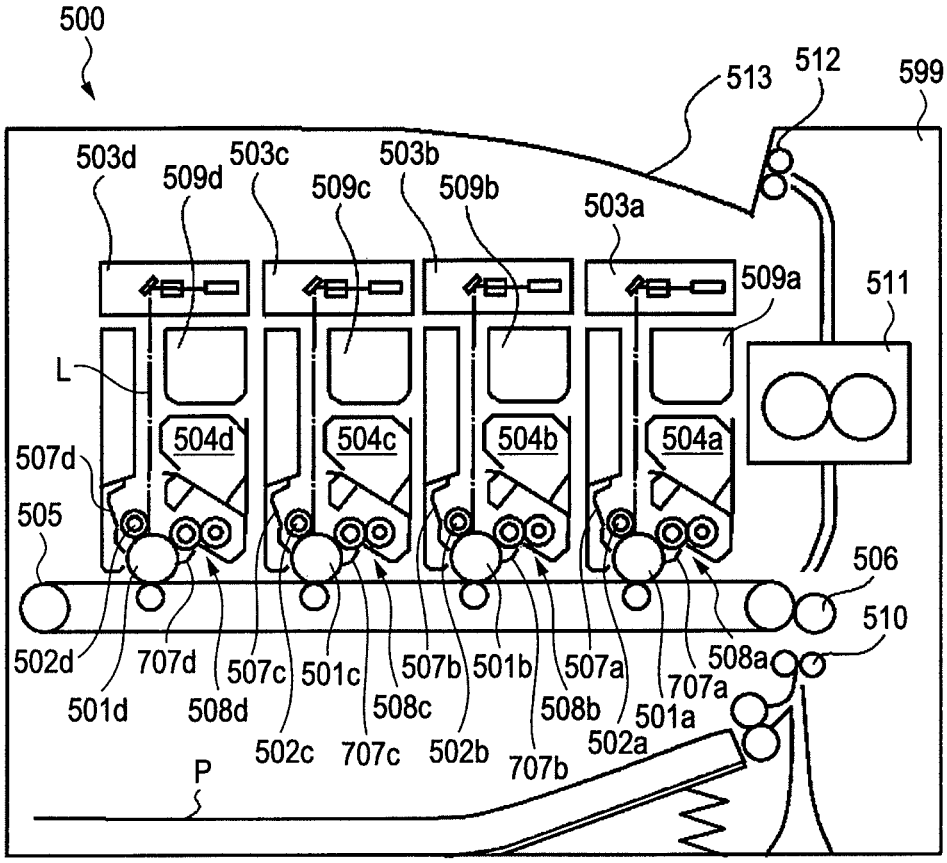
FIG. 11 is a vertical cross-sectional explanatory view illustrating a schematic structure of a color electrophotographic image forming apparatus of a replenishment type according to Embodiment 2 of the present invention.

Next, referring to FIG. 11, the schematic structure of a color electrophotographic image forming apparatus 500 according to Embodiment 2 of the present invention will be described. In the following description, a longitudinal direction refers to a direction in which a process cartridge 508 is mounted to the color electrophotographic image forming apparatus 500, and the longitudinal direction intersects with (is substantially orthogonal to) a conveying direction of the recording medium P. The longitudinal direction is the same direction as an axial direction of the photosensitive drum 501. A transversal direction refers to the right and left direction when viewed from the axial direction (that is, a direction intersecting with the longitudinal direction). Further, a vertical direction refers to an up-and-down direction in a state in which the process cartridge 508 and the toner (developer) cartridge 509 are mounted to the apparatus main body.

First, a schematic structure of the color electrophotographic image forming apparatus 500 of a replenishment type illustrated in FIG. 11, specifically, an entire full-color laser beam printer will be described. The image forming apparatus 500 illustrated in FIG. 11 includes four photosensitive drums 501 (501*a*, 501*b*, 501*c*, 501*d*) arranged in parallel in a substantially horizontal direction. The photosensitive drum 501 is rotated by a driver (not shown). On the periphery of the photosensitive drum 501, a charging roller 502 (502*a*, 502*b*, 502*c*, 502*d*), an exposure unit 503 (503*a*, 503*b*, 503*c*, 503*d*), a developing unit 504 (504*a*, 504*b*, 504*c*, 504*d*), an intermediate transfer belt 505, and cleaning blade 507 (507*a*, 507*b*, 507*c*, 507*d*) are provided. As is well-known, the above-mentioned charging roller 502 (502*a*, 502*b*, 502*c*, 502*d*) uniformly charges the circumferential surface of the photosensitive drum 501, and the exposure unit 503 (503*a*, 503*b*, 503*c*, 503*d*) forms an electrostatic latent image on the photosensitive drum 501 by irradiating the photosensitive drum 501 with laser light L based on image information. Further, the developing unit 504 (504*a*, 504*b*, 504*c*, 504*d*) allows toner (developer) to adhere to the electrostatic latent image to develop a toner (developer) image, and the developing unit 504 is disposed at one end side of the photosensitive drum 501 in the transversal direction of the photosensitive drum 501. An intermediate transfer belt 505 allows the toner (developer) image formed on the photosensitive drum 501 to be transferred thereto. A second transfer roller 506 transfers the toner (developer) image transferred to the above-mentioned intermediate transfer belt 505 onto the recording medium P.

Meanwhile, a cleaning blade 707 (707*a*, 707*b*, 707*c*, 707*d*) removes toner remaining on the circumferential surface of the photosensitive drum 501 after the transfer. The removed toner is transported to the front side of the main body by the transport screw similar to that of the above-mentioned embodiment, and is collected in the collecting box (not shown) disposed on the front side of the main body.

Here, each of the photosensitive drum 501, the charging roller 502, the developing unit 504, and the cleaning blade 507 described above are structured as a part of the unit to be detachably mountable integrally to the main body. The unit in which the photosensitive drum 501, the charging roller 502, the developing unit 504, and the cleaning blade 507 are integrated forms the process cartridge 508 (508*a*, 508*b*, 508*c*, 508*d*). The frame structure of the process cartridge 508 will be described later. In an upper part of the process cartridge 508, a toner (developer) cartridge 509 (509*a*, 509*b*, 509*c*, 509*d*) for supplying toner (developer) is disposed in a removable manner. When the process cartridge 508 is mounted to the main body, a portion to be positioned provided in the process cartridge 508 is positioned in a positioning portion (not shown) provided in the main body.

Figure 12:
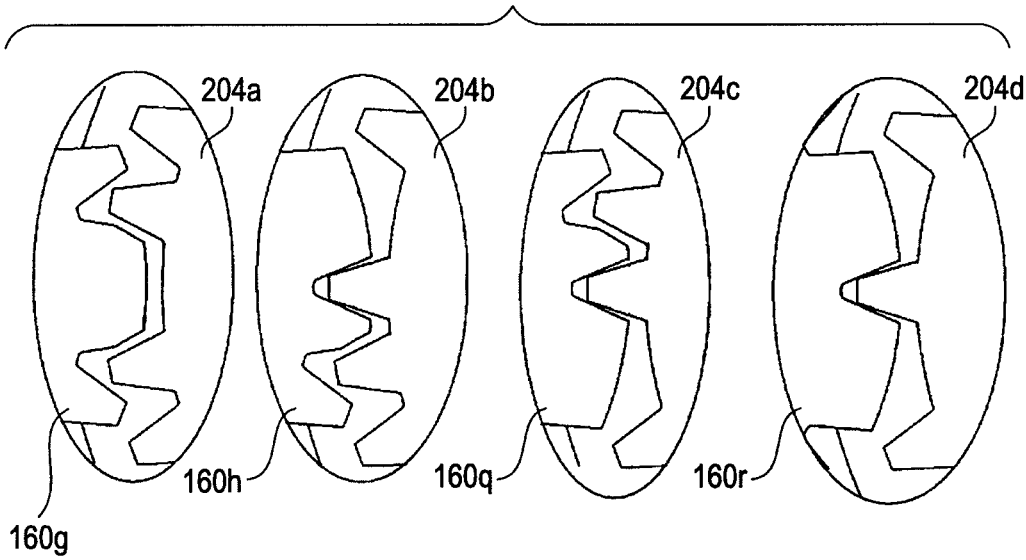
FIG. 12 is a side explanatory view illustrating a mesh relationship between an intermediate gear of a process cartridge and an operation lever gear used in the apparatus illustrated in FIG. 11 in a partially enlarged state.

Each process cartridge 508 is provided with the toner discharge portion, the operation lever, and components related thereto, in the same way as in Embodiment 1 described above, and intermediate gears and operation lever gears provided in the four process cartridges 508 are structured, for example, as illustrated in FIG. 12. More specifically, the process cartridge 508 as a unit in this embodiment is provided with the intermediate gear 160 (160*g*, 160*h*, 160*q*, 160*r*) transmitting a rotation force to the cover pipe 152, and the suitability of the unit to be mounted to the copying machine main body is determined based on the mesh state of the intermediate gear 160.

More specifically, the operation lever gear 204 (204*a*, 204*b*, 204*c*, 204*d*) that enables the collecting box mounted to each process cartridge 508 (508*a*, 508*b*, 508*c*, 508*d*) for each color to be mounted and detached and the intermediate gear 160 (160*g*, 160*h*, 160*q*, 160*r*) corresponding to the operation lever gear 204 are different in a gear shape for each color. Thus, even when the process cartridge 508 of different color is erroneously attempted to be mounted to a mounting portion of different color of the main body, the process cartridge of the wrong color cannot be mounted completely.

Thus, in the same way as in Embodiment 1 described above, a protruding portion (not shown) provided at a copying machine front cover and the operation lever interfere with each other to make it impossible to close the copying machine front cover, and there is provided a control system which does not allow an operation with a sensor (not shown) in a state in which the copying machine front cover is opened.

Thus, according to this embodiment, in addition to the above-mentioned embodiment, the mounting of the improper process cartridge (unit) 508 is determined based on the mesh state of the intermediate gear 160. Therefore, the mounting of the proper process cartridge 508 is ensured easily.

Figure 13:
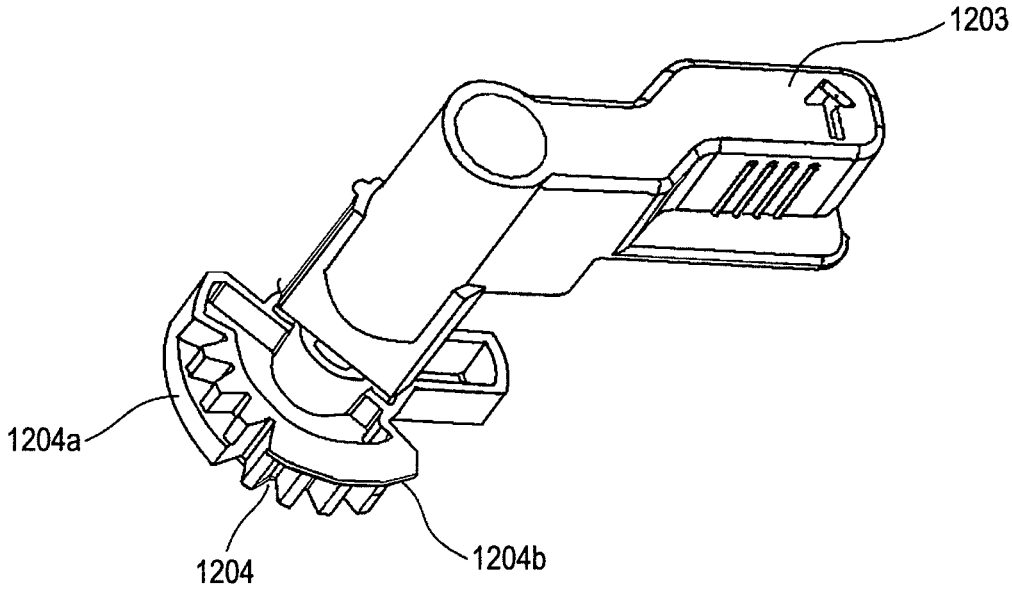
FIG. 13 is a perspective explanatory view of an external appearance illustrating structures of an operation lever and an operation lever gear in Embodiment 3 of the present invention.

Next, Embodiment 3 of the present invention will be described. Even in Embodiment 3, the drum cartridge similar to that in Embodiment 1 described above is provided, and the drum cartridge is provided with the toner discharge portion, the collecting box, etc. similar to those in Embodiment 1. Then, an operation lever 1203 is provided with an operation lever gear 1204 that is a feature of this embodiment as illustrated in FIG. 13.

Figure 14A:
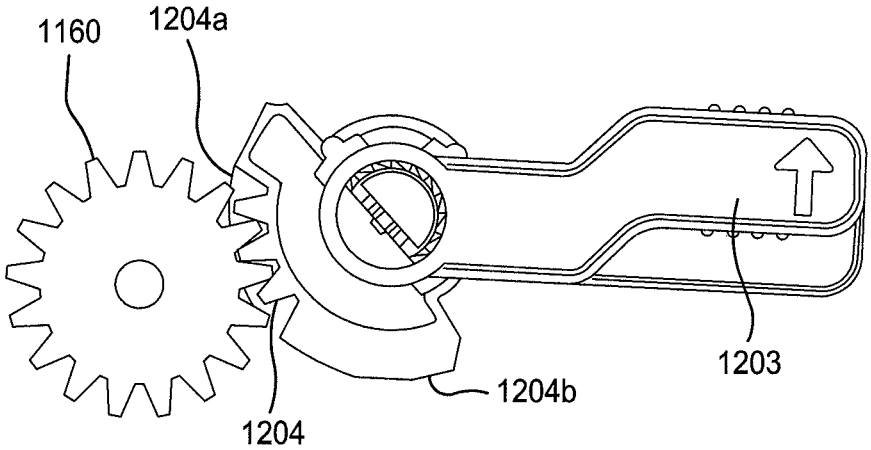
FIG. 14A is a front explanatory view illustrating schematically a positional relationship between the operation lever illustrated in FIG. 13 and an intermediate gear in a state in which a collecting box is attached.

More specifically, the operation lever gear 1204 is provided with flanges 1204*a*, 1204*b* at different phase angles at both sides in the gear width direction. As illustrated in FIG. 14A, when the operation lever 1204 is rotated in the counterclockwise direction as illustrated in FIG. 14A, the drum cartridge can be mounted and the collecting box can be replaced. At this time, the direction from the front surface side to the back surface side of the drawing sheet of FIG. 14A is a direction in which the drum cartridge is mounted. In this state, the flange 1204*a* comes into contact with an intermediate gear 1160, and the lock of the intermediate gear 1160 is released in the same way as in FIG. 10 of Embodiment 1.

Figure 14B:
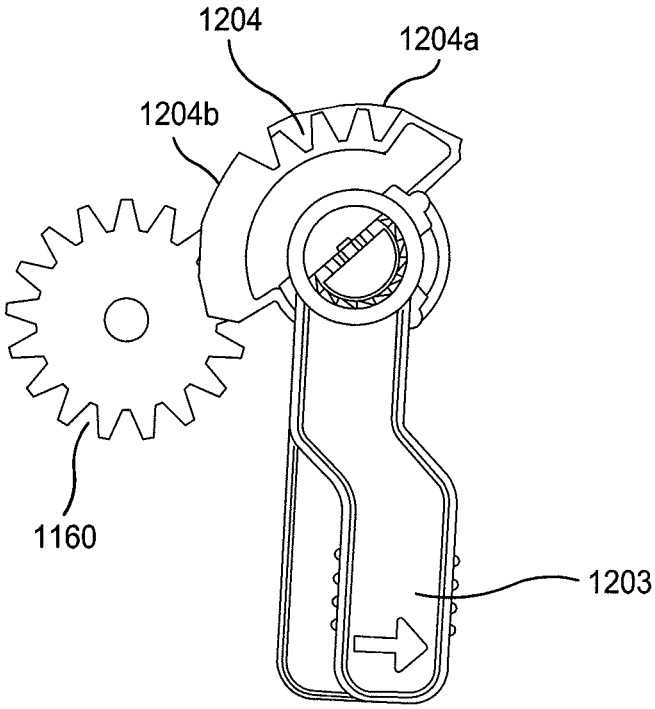
FIG. 14B is a front explanatory view illustrating schematically a positional relationship between the operation lever illustrated in FIG. 13 and an intermediate gear in a state in which the collective box is removed.

On the other hand, the collecting box is mounted following the above-mentioned drum cartridge, and the operation lever 1204 is rotated in the clockwise direction as illustrated in FIG. 14B. In this state, the flange 1204*b* regulates the movement of the intermediate gear 1160 in the direction in which the drum cartridge is pulled from the back surface side to the front surface side of the drawing sheet of FIG. 14B, and the drum cartridge cannot be pulled out due to the regulation function.

The embodiments of the invention by the inventors of the present invention are described specifically. However, the present invention is not limited to the embodiments, and needless to say, the present invention can be varied within a scope not deviating the spirit.

For example, in the above-mentioned embodiments, the present invention is applied to a copying machine. However, the present invention can be applied similarly to an image forming apparatus such as a printer.

As described above, the toner collecting apparatus and the cartridge, and the image forming apparatus according to the present invention can be applied widely to various image forming apparatuses such as a printer and a copying machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese patent Applications No. 2009-293547, filed Dec. 24, 2009, and No. 2010-281412, filed Dec. 14, 2010, which are hereby incorporated by reference herein in their entirety.

What is claimed is:

1. A toner discharging apparatus which discharges toner to a detachably mountable toner receiving portion which is detachably attached to the toner discharging apparatus, the toner discharging apparatus comprising:

a discharge unit configured to discharge the toner from a discharge port;

a lid member configured to open and close the discharge port of the discharge unit; and a cover member provided on the toner discharging apparatus and positioned to oppose at least a part of an open area of the lid member which opens the discharge port of the discharge unit without exposing the part of the open area when the toner receiving portion is detached from the toner discharging apparatus.

2. A cartridge integrally detachably mountable to a main body of an image forming apparatus, the cartridge comprising a toner discharging apparatus according to claim 1.

3. An image forming apparatus, comprising a cartridge according to claim 2.

4. A cartridge according to claim 2, further comprising a lock mechanism that disables a rotation of the lid member when the cartridge is detached from the main body.

5. An image forming apparatus, comprising a cartridge according to claim 4.

6. A cartridge according to claim 2, further comprising an intermediate gear that transmits a rotation force to the lid member, wherein suitability in use of the cartridge to be mounted to the main body for the main body is determined based on a mesh state between the intermediate gear and a gear of the main body.

7. An image forming apparatus, comprising a cartridge according to claim 6.

8. An image forming apparatus, comprising a toner discharging apparatus according to claim 1.

9. A toner discharging apparatus according to claim 1, wherein the open area of the lid member is an open hole which opens the discharge port of the discharge unit, and the lid member is rotatable between a position in which the open hole opens the discharge port and a position in which the lid member closes the discharge port.

10. A toner discharging apparatus according to claim 1, wherein the toner is waste toner removed from an image bearing member used for forming an image on a recording medium.

* * * * *